United States Patent [19]

Witbeck

[11] Patent Number: 4,628,776

[45] Date of Patent: Dec. 16, 1986

[54] ROTARY IMPACT LUG TOOL

[76] Inventor: Melverton R. Witbeck, 3867 Meadowlawn Loop, SE., No. 4, Salem, Oreg. 97301

[21] Appl. No.: 785,207

[22] Filed: Oct. 7, 1985

[51] Int. Cl.[4] ..... B25B 19/00; B25B 21/00

[52] U.S. Cl. ..... 81/466; 173/93

[58] Field of Search ..... 81/466, 463, 465; 173/93, 94, 96, 101

[56] References Cited

U.S. PATENT DOCUMENTS

| | | | |
|---|---|---|---|
| 1,990,197 | 2/1935 | Mohr | 173/93 |
| 2,279,118 | 5/1942 | Fortune et al. | 81/466 |
| 2,308,428 | 1/1943 | Ronning et al. | 173/93 |
| 2,313,398 | 3/1943 | Ronning | 173/93 |
| 3,158,050 | 11/1964 | Shandel | 81/466 |

FOREIGN PATENT DOCUMENTS

| | | | |
|---|---|---|---|
| 2097309 | 11/1982 | United Kingdom | 81/463 |

*Primary Examiner*—Frederick R. Schmidt
*Assistant Examiner*—Bradley I. Vaught
*Attorney, Agent, or Firm*—Marger & Johnson

[57] ABSTRACT

A rotary impact lug tool includes a shaft, a rocker stop block assembly and an elongated rotary member. The shaft includes a socket extension to engage a lug nut. The rotary member is centrally mounted for relative rotation on the shaft. The rocker stop block assembly includes two flat oblong plates fixedly mounted on the shaft in parallel relationship normal to the shaft. Two diametrically opposed stop blocks are affixed to and sandwiched between the plates at equal predetermined radii from the shaft. The rotary member is housed between the plates. Upon spinning, the rotary member simultaneously strikes parallel planar impact surfaces of both stop blocks. The resultant angular impulse is transferred through both plates of the rocker stop block assembly to the shaft, thereby loosening the nut.

3 Claims, 9 Drawing Figures

ROTARY IMPACT LUG TOOL

BACKGROUND OF THE INVENTION

This invention relates to tools for tightening and loosening lug nuts and similar threaded members and in particular to rotatable impact wrenches.

The conventional lug wrench for adjusting such threaded members comprises a nut-engaging end piece, a shaft extending axially rearwardly therefrom and a cross member affixed transversely to the shaft to apply torque to the shaft and thereby rotate the nut. Such manual tools are only suitable for tightening and loosening lug nuts and bolts within a relatively low range of applied torque.

Most auto shops and tire dealers use pneumatic or electric lug tightening machines. Passenger car nuts are usually secured at 70–95 ft-lb torque; truck nuts may be secured at up to 450–500 ft-lb of torque. The large and numerous lug nuts on trucks, farm implements and similar large vehicles are usually tightened by such lug tightening machines. When on the road or in the field, the truck driver or farmer typically has no access to or power for such powered lug machines. Such person is often unable to loosen machine tightened nuts or bolts, especially large, highly-torqued ones, with a conventional lug wrench. Rusted nuts and bolts are likewise difficult to remove.

Various modifications of the conventional manual tool have been tried to overcome this problem.

A long cross member will provide greater torque by increasing the lever arm of the physically applied force. To do so, an extension or "cheater pipe" is applied to one of the cross members of a conventional lug wrench. Extensions of three up to six feet long are commonly used. Still, applying the weight of an adult male to the end of such an extension is sometimes not enough to loosen a stubborn lug bolt. Moreover, increasing cross member length can cause the cross member to bend under applied force. Using an extension can also apply an off-axis torque to the shaft and lug nut or bolt. Application of off-axis torque can break the bolt or the stud on to which the lug is threaded-a disastrous consequence. Providing the support necessary to direct torque about the proper axis can make the wrench too large and heavy to take conveniently on the road or into the field.

Another form of lug tool is a rotatable impact wrench as shown in Shandel U.S. Pat. No. 3,158,050. It shows a nut-engaging end piece, the central shaft extending axially rearward therefrom, and a rotary member mounted for relative rotation on the central shaft. This rotary member is positioned axially adjacent a planar flange affixed on and extending radially normal to the central shaft. The flange includes two parallel cylindrical abutments extending axially toward and overlapping the plane of rotation of the rotary member in diametrically opposed positions about the central shaft. The ends of the elongated rotary member are weighted. To loosen or tighten a nut, the user spins the rotary member in the desired direction of nut rotation. When the rotary member strikes the abutments, the angular impact is transferred to the flange, central shaft and nut. A sufficient angular impact will loosen the nut.

I have previously constructed and used a Shandel-type lug tool in which the flange and abutments were provided by a U-shaped channel member fixedly mounted on the shaft. The tool was, however, inadequate. With repeated striking, the diametrically opposed channel member flange edges would bend outward, out of the reach of the rotary member, until the tool became non-functional. A similar problem, flange and abutment bending, is likely to occur also in the Shandel tool.

Another disadvantage of Shandel-type rotary impact tools is that they are unsuitable for very large and/or stubborn or "frozen" threaded members. Highly-torqued or frozen nuts or bolts require greater applied torque or angular impact to loosen than do their smaller and less tight counterparts. Available rotational space between the abutments limits the attainable rate of rotation of the rotary member. Therefore, in practice, to provide angular momentum producing an angular impact sufficient to break free large or stubborn nuts requires increasing the moment of inertia of the rotary member. This can be done by making the impact weights heavier. Here problems arise. Increasing the moment of inertia would expedite bending of the channel member flange edges or abutments and flange, rendering such tools useless more quickly than with the lighter weights. The problem thus remains that the closer that the manual tool comes to being able to free all types of nuts, the greater the likelihood of self-destructing the tool or breaking the threaded member.

Accordingly, a need remains for a durable, manual lug tool that can loosen without breaking even large, highly-torqued or frozen lug nuts or bolts.

SUMMARY OF INVENTION

It is, therefore, an object of the invention to improve manual lug tools by providing a tool capable of manually loosening highly-torqued or frozen lug nuts or bolts.

Another object is to provide a durable lug tool capable of effective long hard use on all sizes of lug nuts and bolts.

Another object is to provide substantial torque axially to the threaded member, but not at an angle to that axis.

Another object is to provide a tool that is readily adaptable to any size of threaded member.

The present invention incorporates into a rotatable impact lug wrench a rocker stop block assembly. The rocker stop block assembly replaces the prior art channel member and flange and abutment assembly; it overcomes the fatigue problems of the prior art. The rocker stop block assembly comprises two flat plates centrally, fixedly mounted upon the central shaft in parallel spaced-apart relationship about the rotationally shaft mounted rotary member. The plates are aligned normally to the shaft, and two diametrically opposed stop blocks are fixedly sandwiched between the plates. The stop blocks thereby rigidly interconnect both of the flat plates on both radial sides of the shaft and both plates are fixed to the shaft on opposite axial sides of the rotary member.

The stop blocks transfer the angular momentum of the rotary member to the shaft as an angular impulse, which works to loosen the nut or bolt. Each stop block has two angularly spaced planar impact faces. Each planar face is oriented to provide that the impact with the rotary member is between the two flat surfaces, as well as that the impact faces of both stop blocks are struck simultaneously by the rotary member. The stop block housing and impact face orientation assure a long useful life for the tool even with repeated use and a large moment of inertia of the rotary member.

The stop blocks, preferably half-octagonal, half-hexagonal, or trapezoidal in shape, are of an angular width in a direction normal to the radius substantially less than the radius of their position in the stop block assembly. That width relationship, along with maximizing that stop block radius position, is consistent with maximum leverage and facilitates the greatest possible range in which the rotary member can rotate. The stop block width is also greater than the stop block depth in the radial direction. This relationship provides substantial rigidity in the stop block assembly and minimizes stop block deformation and shearing in the direction of rotary member rotation.

The plates, even with repeated use, will retain their parallel relationship. Their sandwich arrangement with the stop blocks interconnecting them assures that the plates will not bend or twist in use. The sandwich arrangement and the stop block shape, especially its width in the direction of rotary member rotation, assures that the stop blocks will not deform in the direction of rotation and pull the outer ends of each plate toward each other.

The stop blocks are preferably made of a material having a greater hardness than the rotary member material. In case the stop blocks are nearly but not exactly diametrically opposed, the rotary member material can deform slightly around the stop block it is striking first, so that eventually both stop blocks will be struck simultaneously. The stop blocks are shaped and formed of a sufficiently rigid material so that they will not deform.

The relative hardness of the two different striking surfaces and the construction of the rocker stop block assembly maximizes the efficiency in transfer of angular momentum into angular impulse: very little energy is lost in the collision. Prior rotatable impact wrenches diverted some available energy into bending the channel or flange member.

The foregoing and other objects, features and advantages of the impact tool become more apparent from the detailed description which follows, with reference to the accompanying drawings.

Figure 1:
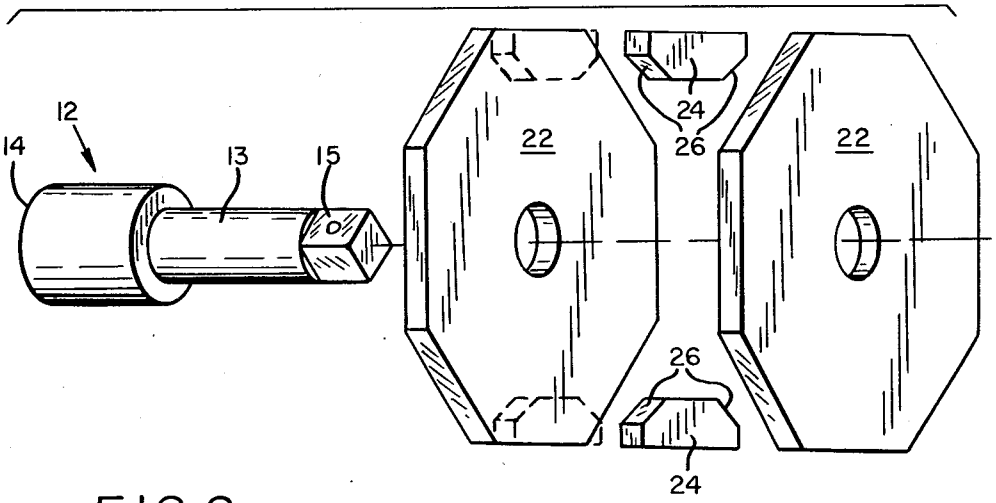
FIG. 1 is an exploded perspective view of the rocker stop block assembly of a rotatable impact wrench in accordance with the invention.
Figure 2A:
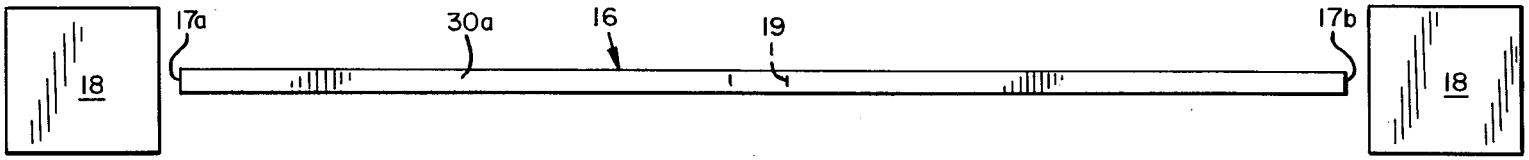

FIGS. *2a* and *2b* are plan and elevation views, respectively, of the rotary member used with the assembly of FIG. 1.

Figure 3:
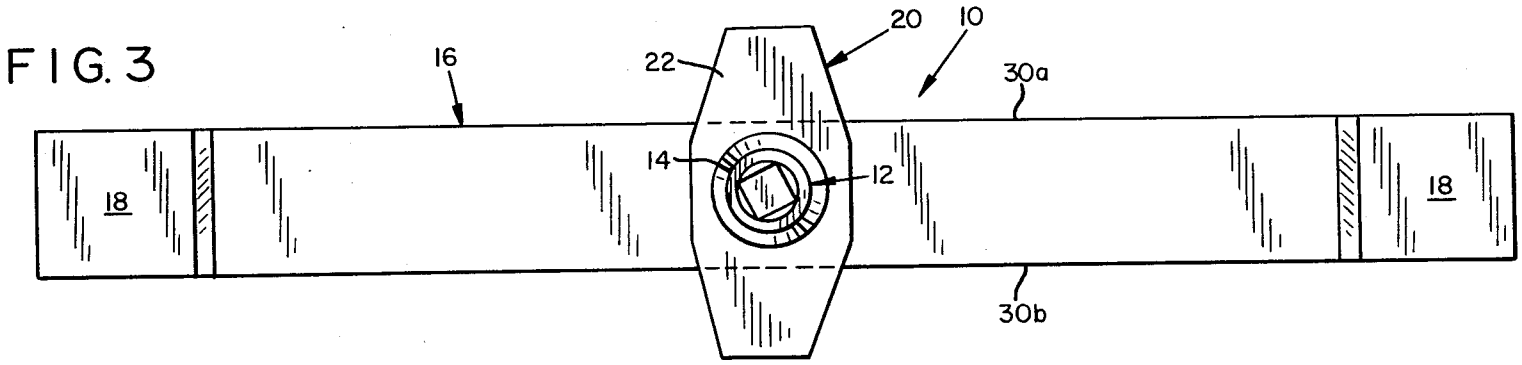

FIG. 3 is a rear elevation view of an assembled rotatable impact wrench according to the invention.

Figure 4:
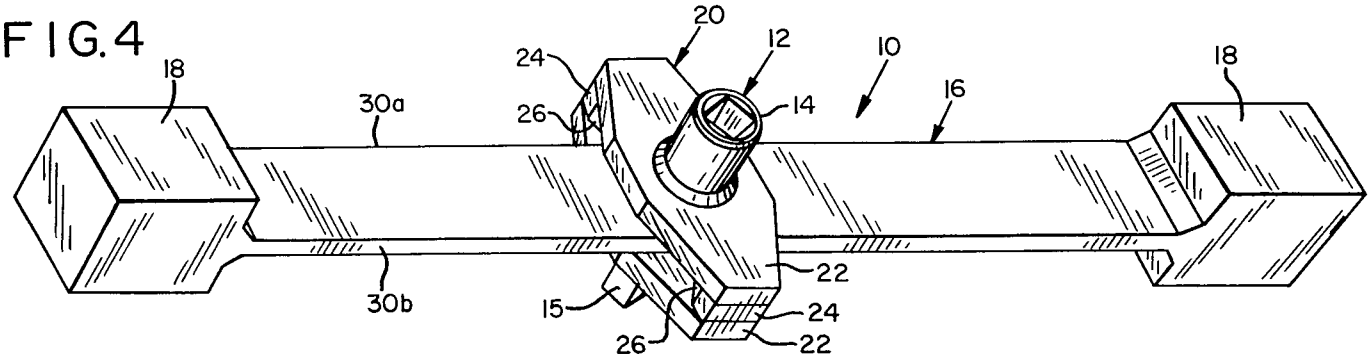

FIG. 4 is a perspective view of the rotatable impact wrench of FIG. 3.

Figure 5:
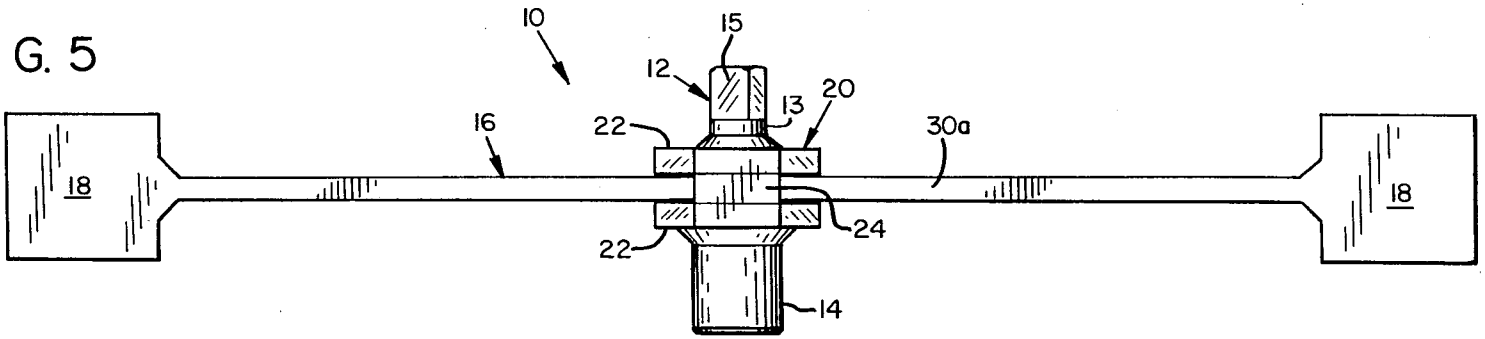
Figure 2B:
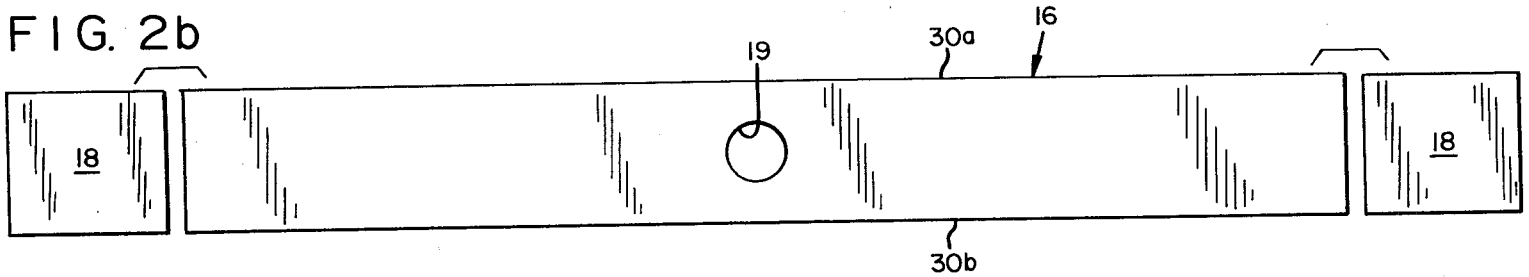

FIG. 5 is a top plan view of the tool of FIG. 3.

Figure 6:
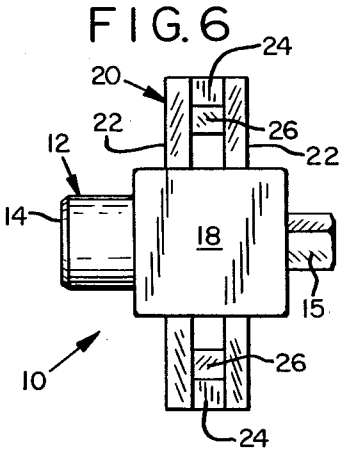
Figure 7A:
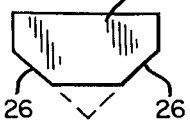
Figure 7B:
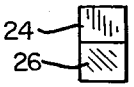

FIG. 6 is an end elevation view of the rocker stop block assembly of FIG. 1.

FIGS. *7a* and *7b* are front and end elevational views, respectively, of one of the stop blocks of FIG. 1.

DETAILED DESCRIPTION

Referring to FIG. 4, a rotatable impact wrench 10 in accordance with the invention comprises a shaft means 12 for engaging the nut and delivering an angular impulse thereto, an elongated rotary member 16 to which an angular momentum is imparted, and a rocker stop block assembly 20 for abruptly stopping the rotation of the rotary member, creating an angular impulse, and transferring that angular impulse to the shaft means.

FIG. 1 shows shaft means 12 including a central shaft 13, female socket end 14 extending axially from the central shaft, and a male socket end 15 mounted on the end of the central shaft opposite that of the female socket end.

FIGS. *2a* and *2b* show the elongated rotary member 16, preferably of #1040 cold roll steel, having two end portions *17a*, *17b* extending radially in opposite directions from a center hole 19. The rotary member is mounted upon the central shaft, received through hole 19, for rotation relative to the shaft means. Two equal-sized impact weights 18 are mounted, one on each end portion 17 of the rotary member, at equal radii from hole 19. The rotary member has a predetermined width, e.g., 2 inches, in the plane of its rotation about the shaft means. Two narrow planar striking faces 30*a*, 30*b* are provided on each portion of the rotary member.

Shaft means 12 is mounted in a rocker stop block assembly 70, for transferring angular momentum of the rotary member to the shaft means as above described. Assembly 20 includes two oblong plates 22 and two stop blocks 24, all preferably of #4140 cold roll steel. As shown in FIGS. 4 and 5, the plates are welded or otherwise fixedly mounted upon the central shaft 13 in aligned parallel relationship, spaced-apart axially about the rotary member, normal to the central shaft.

The two stop blocks 24 are sandwiched between the two plates 22. The blocks are located in diametrically opposed relation across the central shaft 13 at opposite ends of plates and each is welded to both plates. Each stop block 24 has two impact faces 26. The impact faces span the space axially of shaft 13 between the plates 22. Each impact face 26 has a parallel relationship with an impact face 26 on the opposing stop block. The two lines of each parallel pair of impact faces are spaced apart normal to the impact faces by a distance equal to the magnitude of the width of the rotary member. That width is defined by the distance between the two planar rotary member striking faces 30*a*, 30*b*.

In a working example, the stop blocks are at a radius of 2¼" from the shaft to the outermost stop block edges 27. The stop block width in a direction normal to that radius is 1". The planar stop block impact faces are shown truncated at ⅜" in radial length but can be extended to ¾" in length as shown in dashed lines. The greatest stop block depth in a radial direction is less than 1". The stop block thickness in the axial direction is 5/16" and defines a space of equal width between the two plates. Each plate is ⅜" thick in the axial direction and 4½" wide in its maximum dimension normal to the shaft. The rotary member is ¼" thick, 2" wide and 20" long, including the rotary member impact weights. Each impact weight is a cube 2"×2" by 2". The shaft means 3½" long.

OPERATION

The operator secures a lug extension and socket (not shown) to the female socket end and places the lug extension onto the lug to be adjusted. A conventional handle (not shown) is connected to the male socket end. Then the operator aligns the shaft means axially with the nut to be loosened, and fits the socket onto the nut.

Lug nuts usually loosen with counterclockwise rotation. Holding the shaft means in proper alignment with the threaded member axis with one hand, the operator backs the rotary member up in a clockwise direction until it is resting against the stop blocks, assuring the greatest room for angular acceleration. He imparts this angular acceleration to the rotary member by pushing an impact weight 18 vigorously in the counterclockwise direction. This gives the rotary member an angular momentum.

The rotary member strikes both stop blocks 21 simultaneously. All stop block impact faces 26 are planar and are oriented so that the collision between them and the rotary member is between two flat parallel surfaces. Since the striking surfaces are flat and parallel, there will be very little wear on either surface. The angular impulse is transferred from the stop blocks to both plates and from both plates to the shaft, loosening the nut.

An example of my tool sized as described above easily loosens highly torqued truck lugs and rusted bolts on farm equipment. Even though it provides over four times the moment of inertia of my prior Shandel-type tool, it does not fail in repeated use.

Having illustrated and described a preferred embodiment of this invention and the operation thereof, it should be apparent to those skilled in the art that the invention may be modified in arrangement and detail without departing from the invention.

I claim as my invention all such modifications as come within the spirit and scope of the following claims.

1. An impact tool for manually loosening axially rotating threaded members comprising:

a shaft means for transmitting torque axially to the threaded member;

an elongated rotary member mounted upon the shaft means for relative rotation in a plane normal to the shaft means, and having a predetermined moment of inertia; and means for transferring the angular momentum of the rotary member to the shaft means including:

two plates, fixedly mounted on the shaft means in axially spaced-apart parallel relationship normal to the shaft on opposite sides of the rotary member; and two stop blocks sandwiched between and connected to the plates on both axial sides of each block;

said stop blocks being located in radial positions substantially diametrically opposed about the shaft means for converting the angular momentum of the rotary member upon impact with the stop blocks into an angular impulse which is transmitted through the shaft means to the threaded member;

the rotary member having a predetermined width in said plane of rotation and a pair of parallel planar striking faces defining that width, and each stop block having two planar impact faces spaced angularly apart;

each impact face being in a parallel relationship with another impact face on the other stop block and spaced apart therefrom in a direction normal to the impact face a distance equal to said width of the rotary member;

each stop block having a predetermined depth in the radial direction from the shaft means and a predetermined width in the direction normal to that radial direction from the shaft means;

said axial sides of the stop blocks having an area defined by said width and depth, the width being greater than the depth, an axial side of each block being affixed to an adjoining one of said plates over substantially the entirety of said area so as to resist shearing forces exerted by impact of the rotary member against the stop blocks;

the stop blocks being formed of a first material having a first hardness and the rotary member being formed of a second material having a second hardness less than the first hardness, such that if the stop blocks are nearly but not exactly diametrically opposed, the rotary member material can deform slightly around the stop block it is striking first, so that eventually both stop blocks will be struck simultaneously.

2. An impact tool according to claim 1 in which the stop blocks are positioned at a predetermined radius from the shaft means, the stop blocks being sized to an axial thickness defining a spacing between the plates that is substantially less than said radius.

3. An impact tool according to claim1 in which the rotary member and stop blocks each have an axial thickness less than the radial depth of the stop blocks.

* * * * *